US005483617A

United States Patent [19]

Patterson et al.

[11] Patent Number: 5,483,617

[45] Date of Patent: Jan. 9, 1996

[54] ELIMINATION OF FEATURE DISTORTIONS CAUSED BY ANALYSIS OF WAVEFORMS

[75] Inventors: Roy D. Patterson; John W. Holdsworth, both of Cambridge, United Kingdom

[73] Assignee: Medical Research Council, London, England

[21] Appl. No.: 293,119

[22] Filed: Aug. 19, 1994

Related U.S. Application Data

[63] Continuation of Ser. No. 776,360, filed as PCT/GB90/00766, May 23, 1992, abandoned.

[30] Foreign Application Priority Data

May 18, 1989 [GB] United Kingdom ..... 8911376

[51] Int. Cl.[6] ..... G10L 3/02; G10L 9/00

[52] U.S. Cl. ..... 395/2.16; 395/2.15; 395/2.14; 395/2.1; 381/41

[58] Field of Search ..... 381/41–44; 395/2, 395/2.1, 2.2, 2.14–2.16, 22, 2.77

[56] References Cited

U.S. PATENT DOCUMENTS

| | | | |
|---|---|---|---|
| 3,770,892 | 11/1973 | Clapper | 179/1 |
| 3,947,636 | 3/1976 | Edgar | 179/1 P |
| 4,250,471 | 2/1981 | Duncan | 333/14 |
| 4,680,798 | 7/1987 | Neumann | 381/68.4 |
| 4,700,360 | 10/1987 | Visser | 395/2.2 |
| 4,802,225 | 1/1989 | Patterson | 395/2.16 |
| 4,998,280 | 3/1991 | Amano et al. | 381/43 |
| 5,092,343 | 3/1992 | Spitzer et al. | 395/22 |

FOREIGN PATENT DOCUMENTS

| | | | |
|---|---|---|---|
| 1134043 | 10/1982 | Canada . | |
| 0008551 | of 1980 | European Pat. Off. . | |
| 0282336 | 9/1988 | European Pat. Off. | H04R 25/00 |

OTHER PUBLICATIONS

G. L. Clapper: "Automatic word recognition"; IEEE Spectrum, vol. 8, No. 8, Aug. 1971; pp. 57–69.

*Primary Examiner*—Robert W. Downs
*Assistant Examiner*—Tariq Hafiz
*Attorney, Agent, or Firm*—St. Onge Steward Johnston & Reens

[57] ABSTRACT

A waveform to be analysed is spectrally resolved into a plurality of frequency channel outputs (1). Amplitudes of the channel outputs are then compared with threshold values (4), with the threshold values being varied in dependance on 1) previous amplitude detection in the same channel (13, 14, 15) and 2) amplitude detection in adjacent channels (16). In this way features introduced by the spectral resolution of the waveform may be filtered out along with unwanted noise. In addition, smearing due to compression of the output of the spectral resolution may be counteracted. Hence, the present invention is particularly useful in the analysis of sound waves and in speech recognition systems.

23 Claims, 9 Drawing Sheets

ELIMINATION OF FEATURE DISTORTIONS CAUSED BY ANALYSIS OF WAVEFORMS

This is a continuation application of application Ser. No. 07/776,360, filed as PCT/GB90/00766, May 25, 1992, now abandoned.

The invention relates to the analysis of waveforms and more particularly to the two dimensional adaptive thresholding of such waveforms which have been spectrally resolved and apparatus therefor and particularly for use in conjunction with a bank of bandpass channel frequency filters.

BACKGROUND OF THE INVENTION

Analysis of waveforms is particularly applicable to sound waves and to the use of such analysis in hearing aids and speech recognition systems. Some sound wave processors begin the process of analysis by dividing the speech wave into separate frequency channels, either using Fourier transform methods or a filterbank that mimics the filtering encountered in the human auditory system to a greater or lesser degree.

One of the major problems encountered with the use of a filterbank is that the output of the filterbank incorporates not only details of the input speech wave, the source, but also features which are characteristics of the filterbank itself. The features of the output of a filterbank which are caused inherently by the filterbank include the spectral and temporal broadening and smearing of the output relative to the input.

Matched filters are known which counteract the effects caused inherently by a filterbank however such matched filters do not counteract the effects caused in all dimensions of the filterbank i.e. both temporally and spectrally. Furthermore the matched filters replicate but reverse the filterbank effects and are not sensitive or responsive to the actual information due to the source in the output of the filterbank.

It is also necessary for effective speech analysis that unwanted 'noise' which is detected initially is limited or removed from the output of the filterbank and that more important features of the speech wave under analysis are accentuated.

The dynamic range of signals presented to the filterbank is enormous. As a result, the second stage of any analysis commonly involves compression of the dynamic range. Although the compression is often essential, it causes two further problems: it broadens features in the output of the filterbank and reduces the contrast between two adjacent features.

SUMMARY OF THE PRESENT INVENTION

Although the invention may be applied to a variety of waves or mechanical vibrations, the present invention is particularly suited to the analysis of sound waves. The invention is applicable to the analysis of sound waves representing musical notes of speech. In the case of speech the invention is particularly useful for a speech recognition system in which it produces a record of sharpened spectral and temporal features in a reduced dynamic range, which may assist in the distinction between periodic signals representing voiced parts of speech and a periodic signals which may be noise.

The present invention seeks to provide therefore a method for the two dimensional adaptive thresholding of the output of a filterbank and apparatus therefor which removes those features in the output of a filterbank which have been caused inherently by the filterbank in all dimensions simultaneously, which removes unwanted 'noise' from the output of the filterbank, which accentuates particular features appearing in the output of the filterbank due to the source and which counteracts the smearing due to the compression on the output of the filterbank.

The present invention provides a method of analysing a waveform comprising spectrally resolving the waveform into a plurality of frequency channel outputs, detecting amplitudes of said outputs and comparing said amplitudes with respective threshold values for each amplitude detection said threshold value for each channel being varied in dependance on (1) previous amplitude detection in the same channel and (2) amplitude detection in adjacent frequency channels, thereby providing a plurality of output signals representing amplitude detections relative to said threshold values.

The present invention further provides a method wherein a succession of amplitude detections are effected for each channel, the threshold values for each channel being varied dependant on amplitude values derived from a plurality of channels in a previous detection and a method wherein the respective threshold value for each channel is increased to form an adapted threshold value if an adjacent channel has a larger threshold value. Furthermore the invention provides a method wherein after effecting each detection the respective threshold value for each channel is increased to form a revised threshold value if the detected value is greater than the threshold value with which the detected value is compared.

Preferably the invention provides a method wherein the respective threshold value for each channel is arranged to decay in a first direction across the channels across the frequency range and in a second direction along successive detections and wherein the waveform is spectrally resolved by use of a filterbank the rate of decay in both said directions being less than the natural rate of decay of the output of each of the frequency channels of said filterbank.

A second aspect of the invention provides apparatus for analysing a waveform comprising resolving means for spectrally resolving the waveform into a plurality of frequency channel outputs; comparative means coupled to said resolving means for detecting amplitudes of said outputs and comparing said amplitudes with respective threshold values for each amplitude detection; adaptive means coupled to said resolving means and said comparative means, said adaptive means varying said threshold value for each channel in dependance on (1) previous amplitude detection in the same channel and (2) amplitude detection in adjacent frequency channels; and generating means for generating a plurality of output signals representing amplitude detections relative to said threshold values, said generating means being coupled to said resolving means and said adaptive means.

The present invention further provides apparatus wherein said comparative means is a subtracting device which subtracts the respective threshold values in each channel from the amplitudes detected in the same channels, said generating means generating an output signal whenever the result of the subtraction is a positive difference and apparatus wherein said adaptive means includes a first selector which compares the respective threshold value in each channel with the threshold values in adjacent channels and which increases the respective threshold value to form an adapted threshold value if an adjacent channel has a larger threshold value. The invention further provides apparatus wherein said adaptive means further includes a second selector which compares the respective threshold values in each channel with the amplitudes detected in the same channels and which increases the respective threshold value to form a revised threshold value if the amplitude detected is greater than the threshold value with which the detected value is compared.

The present invention provides furthermore a hearing aid device including apparatus hereinbefore described for the analysis of a sound wave, wherein there is further provided combining means coupled to said adaptive threshold apparatus for combining signals for each of the frequency channels with each other to form an output sound wave.

The present invention further provides a hearing aid device, wherein the resolving means provides two outputs for each channel, a first output which is a waveform channel output and a second output which is an envelope function of the waveform channel output and wherein the combining means includes gating means coupled to said adaptive threshold apparatus and said resolving means, for applying the output signals for each of the frequency channels to respective waveform channel outputs to form gated output signals; and adding means coupled to said gated means, for adding said gated input signals for each of the frequency channels with each other to form the output sound wave. Preferably the hearing aid device, further provides controlling means coupled to said adaptive threshold apparatus, said resolving means and said gated means, for scaling said envelope functions for each of the frequency channels relative to said respective output signals such that the amount of variation in the magnitude of the output sound wave may be controlled.

The present invention further provides speech recognition apparatus including apparatus hereinbefore described, together with means for providing auditory feature extraction from analysis of the channel waveforms together with syntactic and semantic processor means providing syntactic and semantic limitations for use in speech analysis of the sound wave.

An embodiment of the invention will now be described by way of example only with reference to the accompanying drawings, in which:

DESCRIPTION OF THE PREFERRED EMBODIMENTS

The two dimensional adaptive thresholding of the output of a filterbank removes or limits the problems caused inherently by the filterbank and by compression of the output of the filterbank. FIGS. 1 to 8 show how an input signal is altered by a filterbank and by compression in firstly the time domain and secondly the frequency domain separately and how the adaptive thresholding of the altered signal in the time domain and the frequency domain separately produces a more accurate representation of the original input signal.

Figure 1:
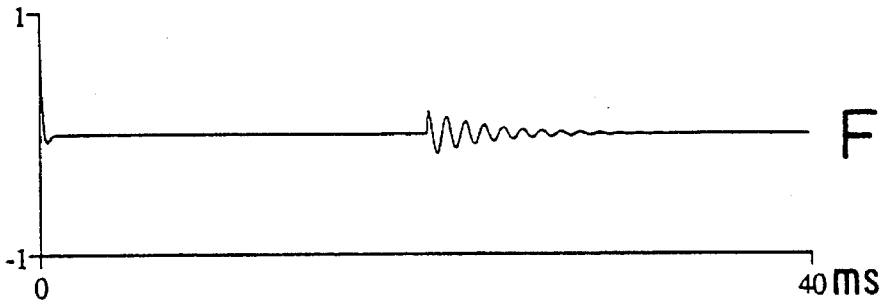
FIG. 1 shows an input signal into a filterbank.
Figure 2:
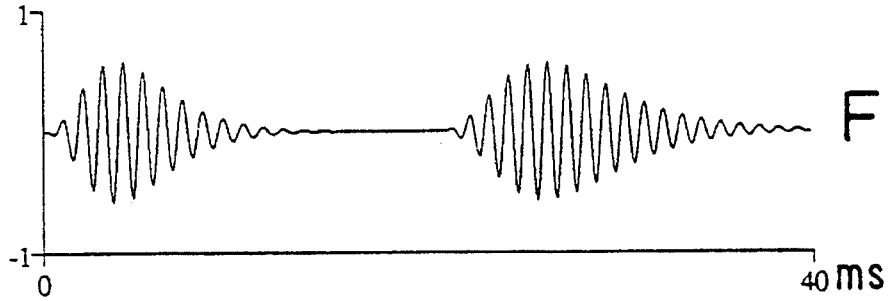
FIG. 2 shows the output of one channel of the filterbank in response to the input signal of FIG. 1.
Figure 3:
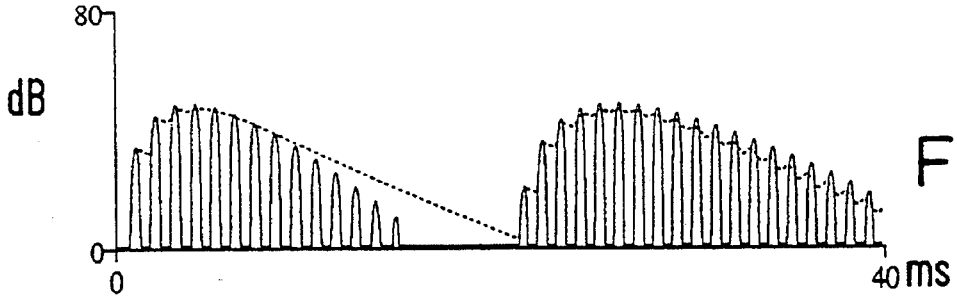
FIG. 3 shows a compressed output of FIG. 2 with the time evolution of a working variable according to the invention.

In FIG. 1 an input composite signal progressing in time is shown in which there is an impulse and an impulse which has been passed through a resonance, the second beginning 20 ms after the first. The Y-axis is the amplitude of the wave. When the composite signal is passed through a bandpass filter centered at 1.0 kHz the resultant output signal from the filter is shown in FIG. 2. It may be seen in FIG. 2 that the two impulses forming the composite signal have been broadened and as a result the two impulses are much more difficult to distinguish between. This broadening is caused by the impulse response of the filter and is an unavoidable by-product of the process of spectral decomposition performed by a filterbank. FIG. 3 then shows the rectified and logarithmically compressed output of the filter, the Y-axis now giving the amplitude of the wave in decibels. The two impulses forming the composite signal are again difficult to distinguish, perhaps even more so following compression.

Figure 4:
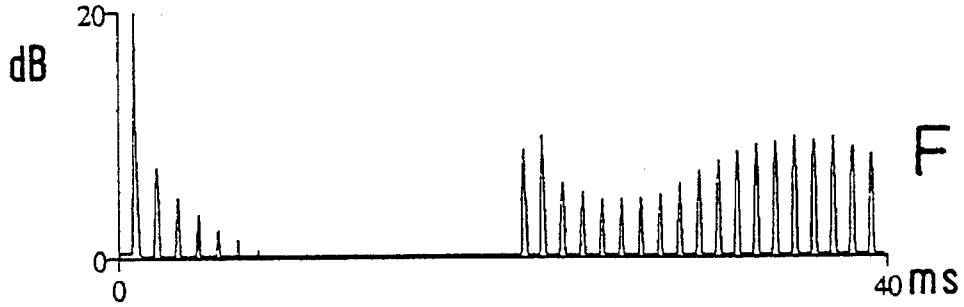
FIG. 4 shows an adapted output of FIG. 3 according to the invention.

The rate of decay of the impulse response of a filter is a negative exponential and since the compressor applies a logarithmic function to the output of the filter the resultant decay function is a straight line with a negative slope. The second impulse which has been passed through a resonator causes the filterbank output to decay more slowly and it is this slower rate of decay that will distringuish the first impulse from the second impulse. The adaptive thresholding distinguishes between the two impulses by measuring the output of the filter relative to the filter's impulse response. FIG. 4 shows the result of adaptive thresholding of the output of the filter and the difference between the two impulses now may clearly be seen. In order to achieve the adaptive thresholding of the output of the filter a working variable is continuously varied in response to the output of the filter and the values of the working variable relative to the filter output may be seen as the dotted line in FIG. 3. The array of working variables forms a working line, the time evolution of which forms a working surface in 3 dimensions.

Figure 5:
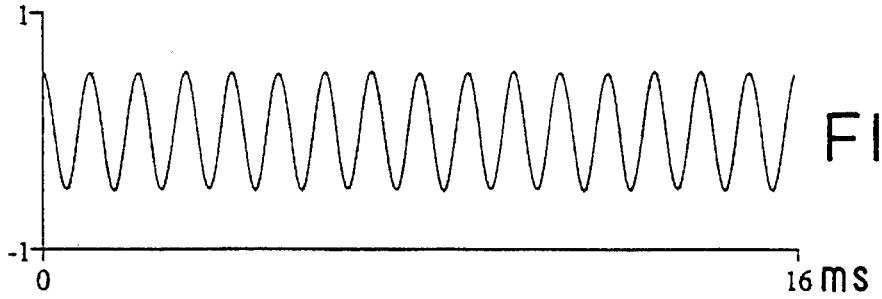
FIG. 5 shows an input signal into a filterbank.
Figure 6:
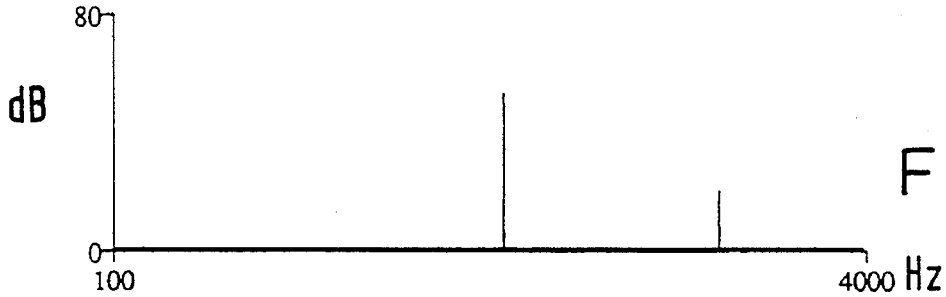
FIG. 6 shows and idealised output across all channels of the filterbank in response to the input signal of FIG. 5.
Figure 7:
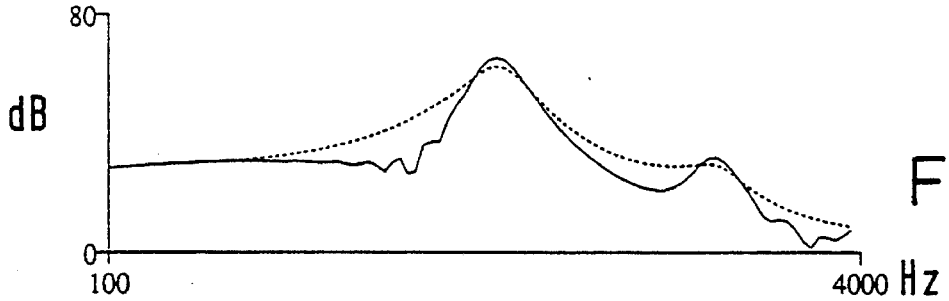
FIG. 7 shows the output across all channels of the filterbank in response to the input signal of FIG. 5 with a working line according to the invention.

In FIG. 5 a composite signal is again shown progressing in time, however, in this case the signal is composed of two sinusoidal components one at 1000 Hz and the other 2300 Hz. The latter sinusoidal component however is 24 dB weaker than the former so that the resultant composite signal is essentially a 1 kHz sine wave because the high frequency element is so small. FIG. 6 shows the long-term or idealised spectrum of the composite signal. The envelope of the response of a whole filterbank at one instance in time to the composite signal is shown in FIG. 7 and as may be seen the filterbank output across the frequency spectrum is far from ideal. Again the spreading of the peaks in the frequency domain is an unavoidable property of any filterbank which has a reasonable temporal response and which cannot integrate forever.

Figure 8:
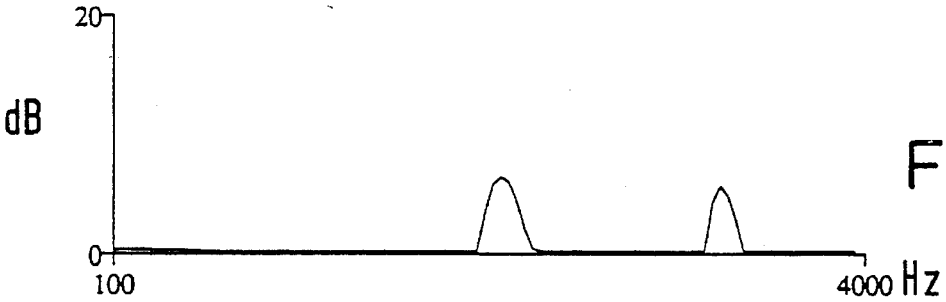
FIG. 8 shows an adapted output of FIG. 7 according to the invention.

The adaptive thresholding apparatus detects spectral features in the frequency domain of the output of the filterbank and takes into account the smearing effects of the filterbank. FIG. 8 shows the resultant signal after adaptive thresholding of the output of the filterbank and as may be seen the resultant output is much closer to the ideal spectrum of FIG. 6 than the filterbank output. The dotted line in FIG. 7 shows the values of the working variables per channel of the filterbank in response to the output of the filterbank at this instant.

In addition, the adaptive threshold apparatus may be arranged so that its response to the filterbank output in either the time or frequency domain or both is set so that the values of the working variables fall away from local maxima more slowly than the rate of decay across the channels of the filterbank. This results in small features which appear in the filterbank output in the region of a larger feature being suppressed. This is useful in that "noise" may also be suppressed in this way.

By the simultaneous combination of the action of the adaptive threshold apparatus in both the time and frequency domains, two dimentional adaptive thresholding is achieved.

Figure 9:
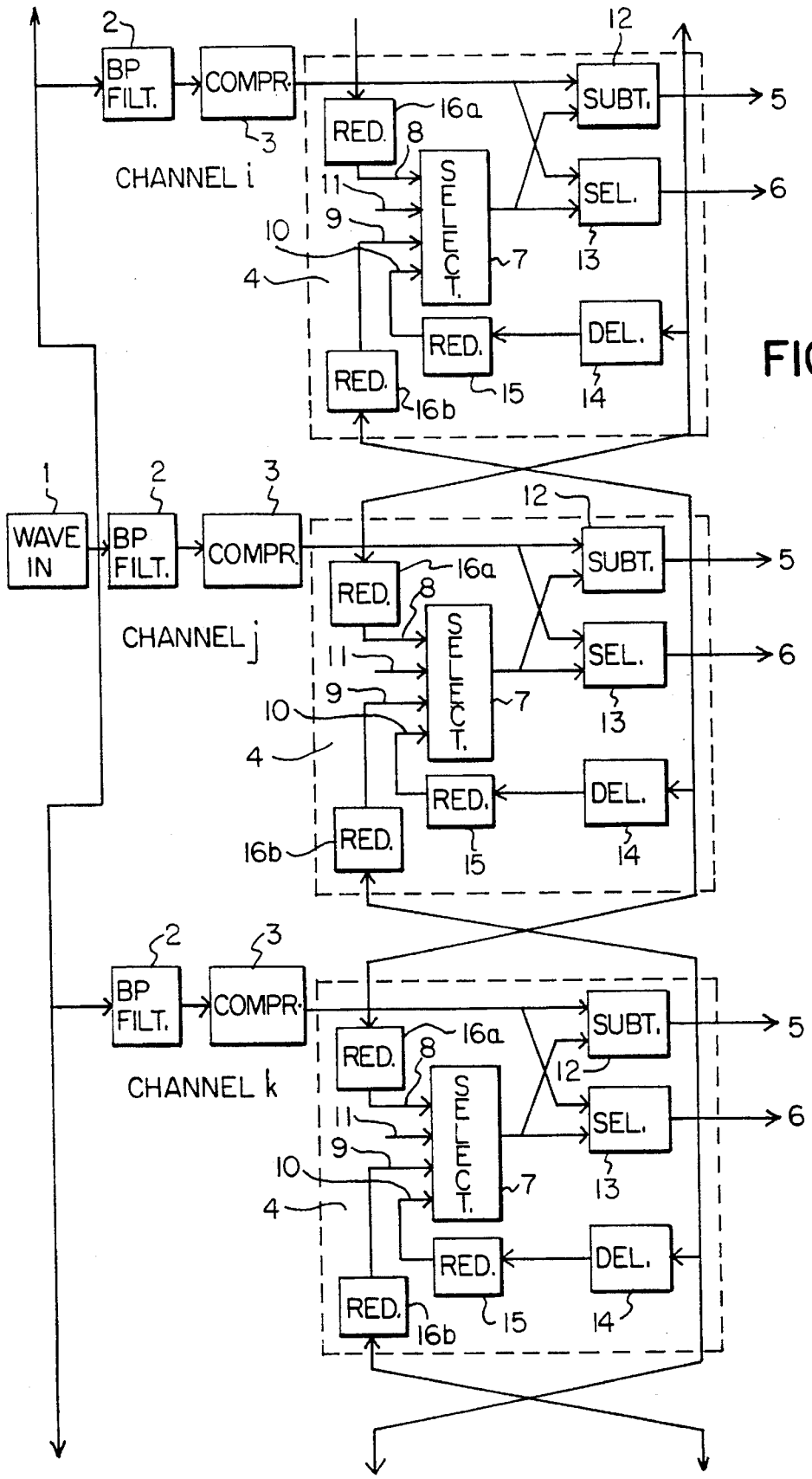
FIG. 9 is a schematic diagram of a method for two dimensional adaptive thresholding according to the invention.

FIG. 9 is a schematic diagram of a method of adaptive thresholding the output from a filterbank. FIG. 9 shows three channels of the filterbank. The filterbank has filters ordered in terms of their centre frequency and the band width of each channel increases with centre frequency from about 70 Hz at 500 Hz to around 380 Hz at 4,000 Hz. The input waveform (1) is input into the bandpass filterbank (2) three adjacent channels of which, channels i,j and k, are shown in FIG. 9. Considering channel j, the output of the filterbank for that channel is input into a compressor (3) which carries out logarithmic compression on the output of the filter for channel j. The output of the compressor (3) is the input into an adaptive threshold device (4) which is deliniated in FIG. 9 by the dashed rectangle.

The adaptive threshold apparatus (4) produces two outputs. The first output signal is an adapted or thresholded output (5) which may be used in the analysis of the input waveform (1). The second output is a working variable or threshold value (6) which is used in the adaptive thresholding of the channel's filter output. At each instant in time the set of thresholded outputs from all the channels forms a frequency vector and over time the frequency vector generates a surface in three dimensions which will be refered to as the output surface. Similarly, at each instant in time the set of working variables from all the channels forms a frequency vector which over time generates a three dimensional surface which will be referred to as the working surface.

The adaptive threshold apparatus (4) has a first selector (7) which selects the maximum from three inputs (8,9,10). The first selector (7) also has a fourth input (11) which inputs a range limit to prevent the adaptive threshold apparatus (4) from responding to and generating an output for "noise". The output in the form of an adapted threshold value or adapted working variable from the first selector (7) is input separately into a subtracting device (12) and a second selector (13). The output of the compressor (3) is also input separately into the subtracting device (12) and the second selector (13).

The subtracting device (12) subtracts the input received from the first selector (7) from the input received from the compressor (3). If there is a positive difference between the two inputs then the subtracting device (12) generates an output which is equal to the difference between the two inputs. The output from the subtracting device (12) is the output signal thresholded output (5). The second selector (13) selects the maximum of the two inputs received as its output in the form of revised threshold value and the output of the second selector (13) is the working variable (6).

The output of the second selector (13), the working variable, is input into a delay device (14). The delay device (14) is coupled to a first reducing means (15) and the first reducing means (15) is in turn coupled to an input (10) of the first selector (7). The delay device (14) delays the input of the working variable into the first selector (7) by one sampling period so that when the first selector (7) is selecting the maximum between inputs (8),(9) and (10) input (10) is the working variable from the previous sample. However, the working variable has also been reduced by the first reducing means (15) prior to being input into input (10) of the first selector (7).

The first reducing means (15) decays the working variable by a predetermined rate which is proportional to the smearing caused by the filterbank in the temporal domain by the impulse response of the filterbank.

Inputs (8) and (9) of the first selector (7) are coupled to second reducing means (16*a*) and (16*b*) respectively. The outputs from the second selectors (13) of the two adjacent channels i and k are input into the second reducing means (16*a*) and (16*b*) respectively. The inputs into the second reducing means (16*a*) and (16*b*) are decayed at a predetermined rate which is proportional to the smearing response caused by the filterbank in the frequency domain. Similarly, the output from the second selector (13), the working variable, is also input into corresponding second reducing means in channels i and k.

Figure 10:
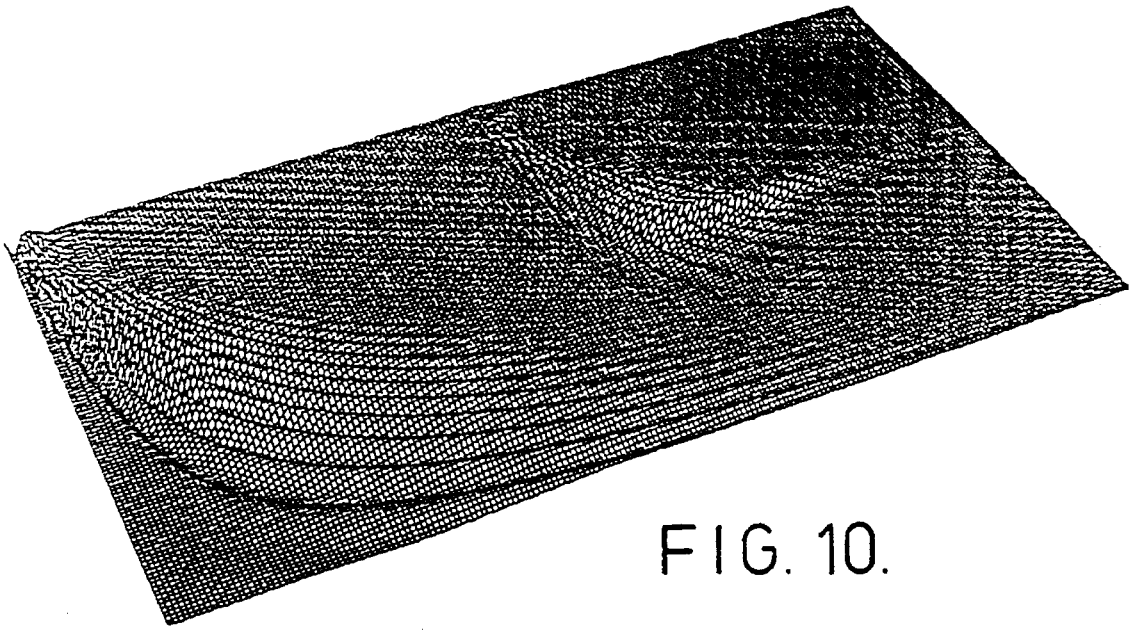
FIG. 10 is a three dimensional surface of the output of all channels of a filterbank in response to the input signal of FIG. 1.

In operation, consider the composite signal shown in FIG. 1, as the input waveform into the filterbank (2) of FIG. 9. FIG. 10 shows the three dimensional surface generated by all the outputs of the channels of the filterbank as a function of time. Time proceeds from the left-hand edge to the right-hand edge of the surface and channel centre frequency increases as one proceeds from the bottom to the top edge of the surface. Each slice through the surface parallel to the bottom edge of the figure shows the output of an individual channel filter. For example, a slice through the centre of FIG. 10 that goes through the ridge produced by the second impulse of the composite signal is the same as shown in FIG. 2.

The left-hand portion of FIG. 10 shows that when the impulse, which is very well defined in time, is passed through the filterbank, the result is much less well defined. This is a direct result of the fact that in order to perform spectral analysis, filters must integrate over time, and the integration limits the rate at which the filter response can die away.

Figure 11:
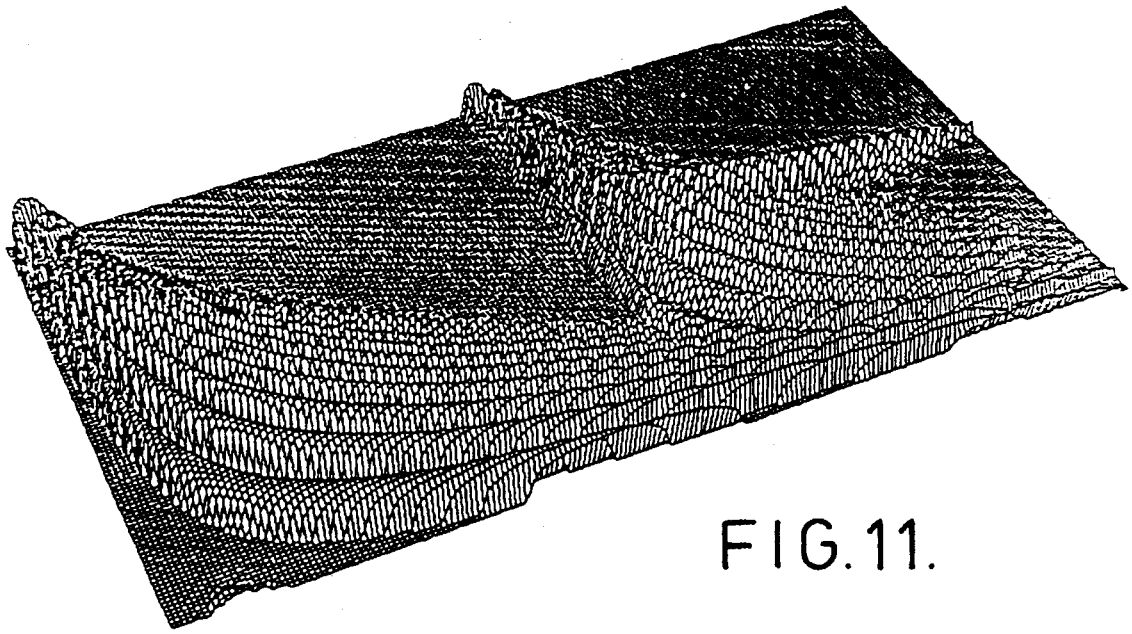
FIG. 11 is a three dimensional surface of the output of FIG. 10 after compression.

The response at the output of all of the compressors (3) in response to the filterbank outputs is shown in FIG. 11. The response at the output of the compressors (3) in response to the first impulse is shown in the left-hand portion of FIG. 11, where it can be seen that the compressive process adds to the temporal smearing. The second impulse of the composite signal has an onset that is well-defined in time and, in addition a feature that is well-defined in frequency, and in this case, we wish to be able to locate both aspects of the signal simultaneously. In the right-hand portion of FIG. 11 we can see that once again, the compressor has added to the smearing problem introduced by the filterbank, and that the smearing problem exists in the frequency domain as well as in the time domain.

Figure 12:
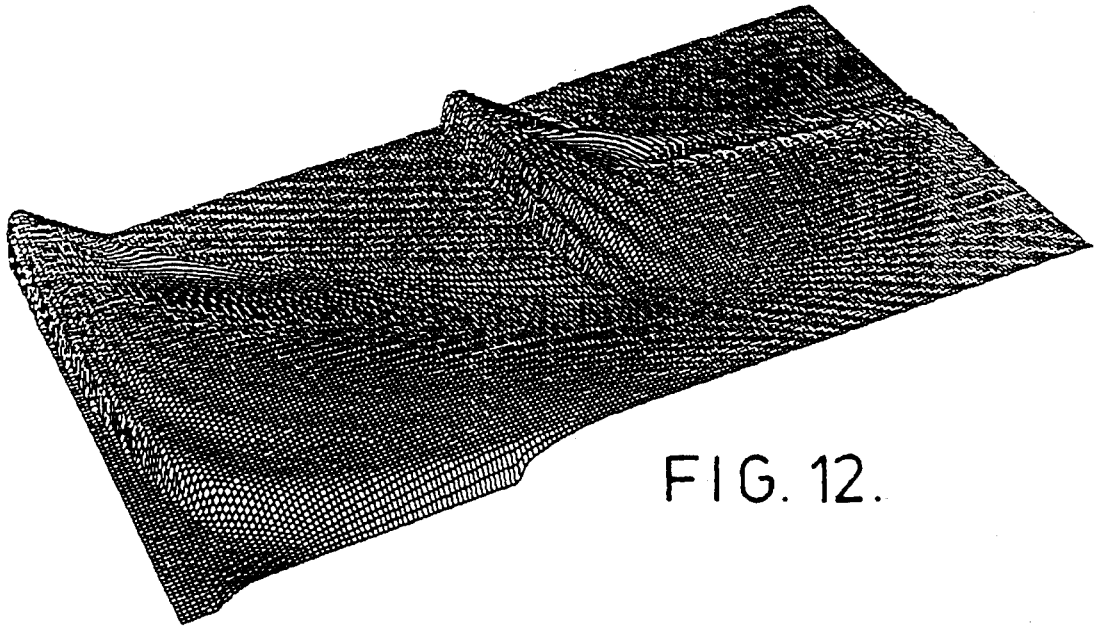
FIGS. 12 and 14 are three dimensional working surfaces in response to the compressed output of FIG. 11 according to the invention.
Figure 13:
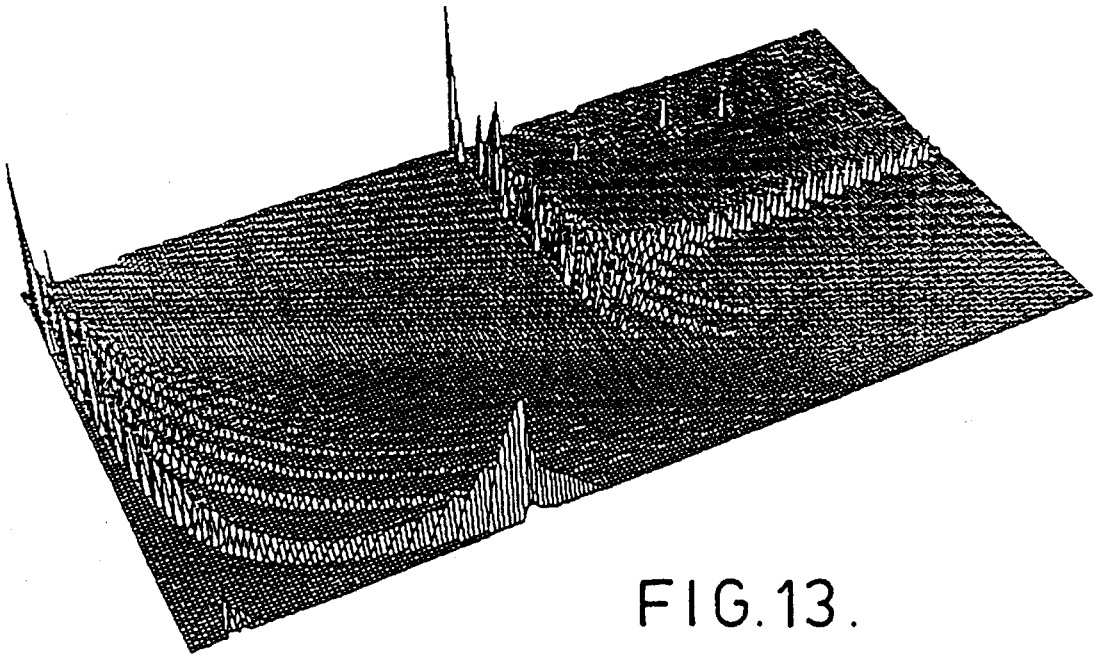
FIGS. 13 and 15 are three dimensional surfaces of the adapted outputs of FIGS. 12 and 14 respectively according to the invention.

In two-dimensional adaptive thresholding the output of the compressors (3) are used to construct a set of working variables (6), one for each channel. The working surface produced by the time history of the array of these variables in response to the composite signal is shown in FIG. 12. It is a smoothed version of the input to the system, and it is this surface which is the two-dimensional adaptive threshold for this signal. When the output of the compressors (3) exceeds this threshold the subtracting device (12) produces an output. FIG. 13 shows the output surface for the composite signal. It may be seen that the response to the impulses is more constrained in time, and that the response to the onset and the resonance of the second impulse of the composite signal are also much better defined in time and frequency, respectively.

Figure 14:
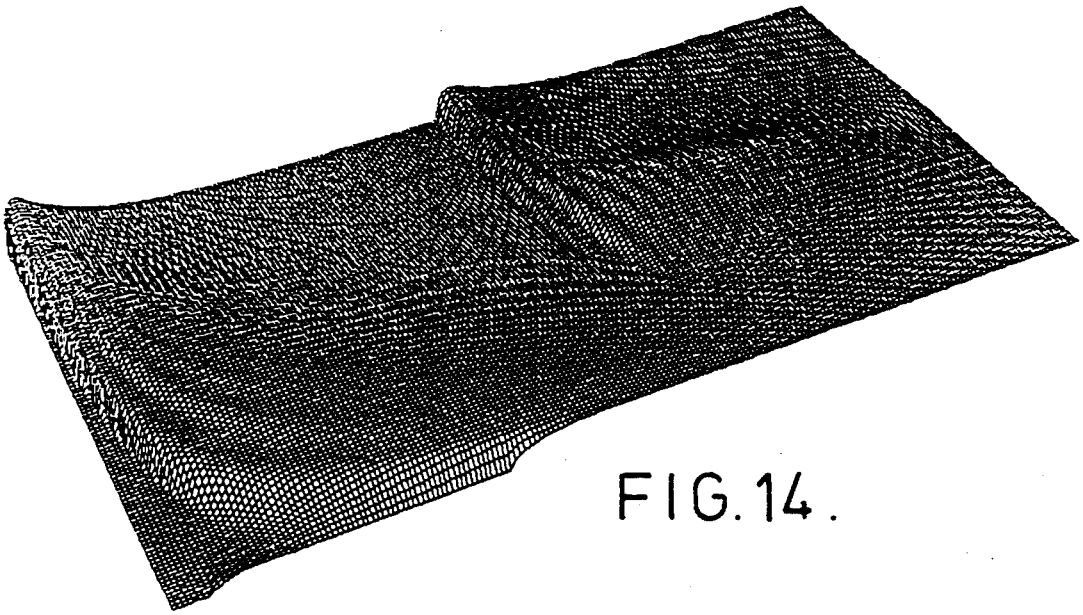
Figure 15:
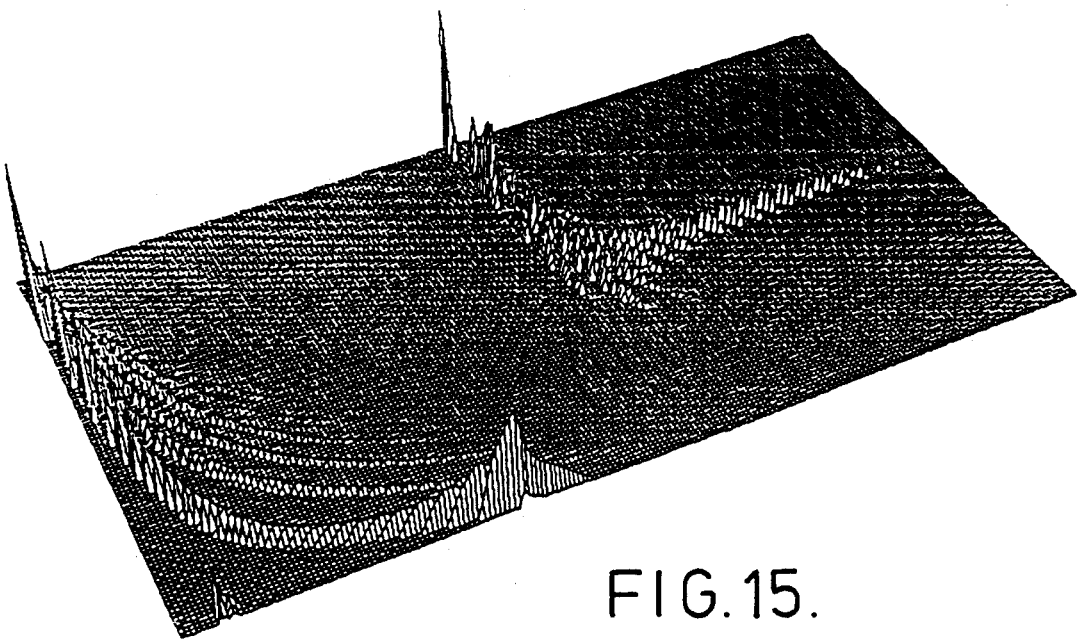

In FIG. 13 three small noise components may be seen in one of the higher channels of the output of the compressors (3) in response to the second impulse of the composite signal (FIG. 11). These three noise components were introduced by the filter and enhanced by the compressor for that channel. At the output of the adaptive threshold apparatus these noise components have been enhanced even further. In order to prevent the enhancement of such small noise features, the range over which the adaptive threshold apparatus can operate is restricted. The results of this restriction are shown in FIGS. 14 and 15. The working surface in FIG. 14 is essentially the same as that shown in FIG. 12 except that the high-frequency channels do not die away to the same degree. In FIG. 15 it may be seen that the noise components no longer exceed the threshold once the range restriction has been imposed and so do not appear on the output surface.

Figure 16:
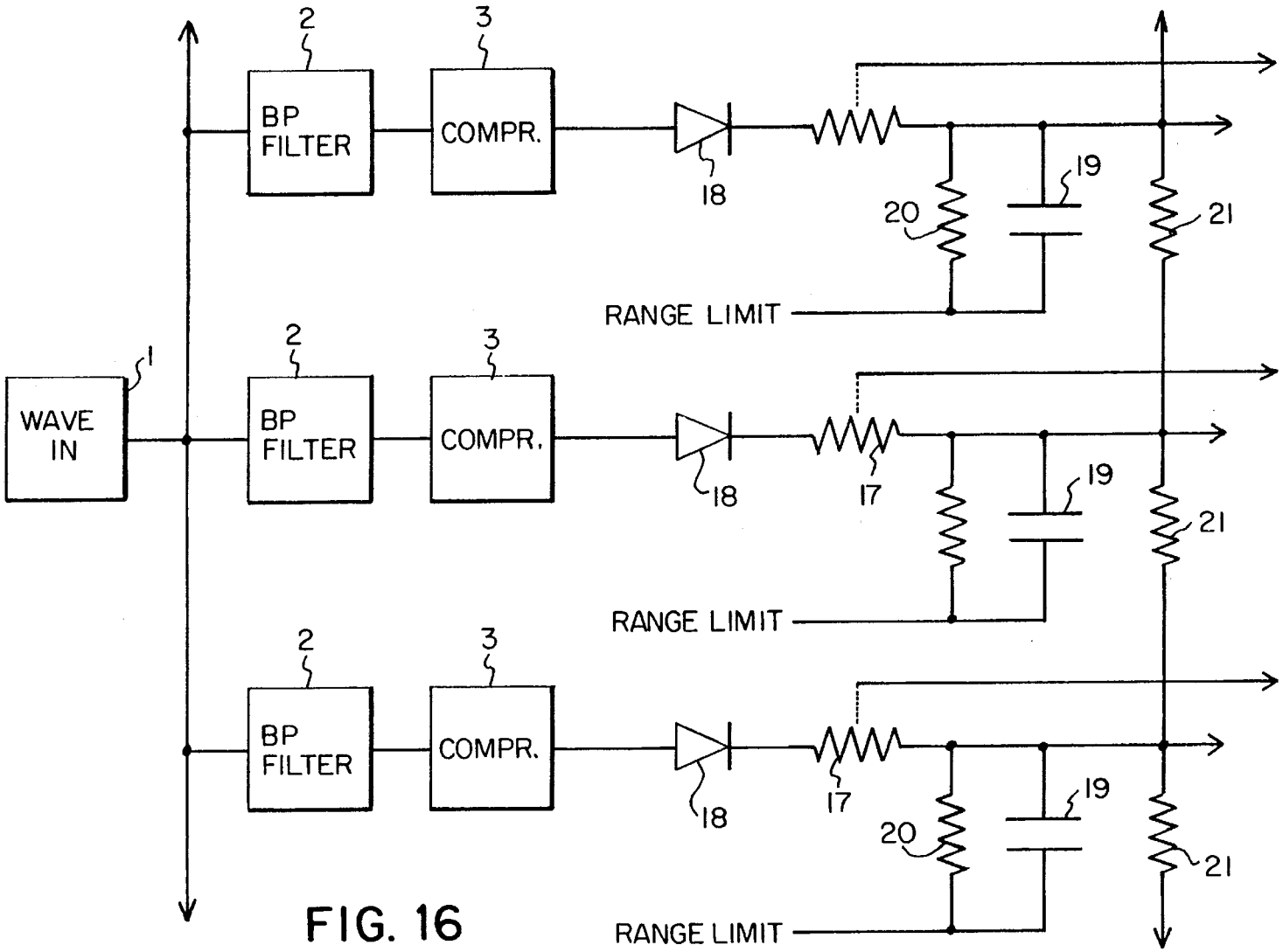
FIG. 16 is a circuit diagram of adaptive threshold apparatus according to the invention.

FIG. 16 shows a circuit for the adaptive threshold apparatus as an example of the type of circuitry necessary to carry out the adaptive thresholding of the output of a filterbank. As previously, Figure (16) shows three channels of the adaptive threshold apparatus. In each case there is a bandpass filter (2) followed by a compressor (3) and then circuitry which generates the working variable (6) and the system output (5) for this channel. In the analogue circuit the working variable (6) is a voltage referred to as the 'working voltage'.

Output is produced when current flows through a very small resistance (17) in each channel. This is equivalent to output being produced when the working variable is raised by the input coming from the compressor (3), as described previously. The diode (18) just after the compressor (3) and before resistance (17) ensures that the input from the compressor (3) can only raise, and never lower, the working voltage. When the input from the compressor (3) is smaller than the working voltage, the voltage is maintained for a time by the capacitor (19). The voltage will slowly dissipate through the large resistor (20). The voltage drains down to the "range limit" which is used, as referred to previously, to limit the system's sensitivity to "noise".

The interaction between the working voltages of adjacent channels is implemented by connecting the channels through a low resistance (21). The operation of the analogue circuit in the frequency domain is somewhat different than that which would be achieved if the block diagram in FIG. 9 were implemented literally. In the case of the block diagram, the rate at which the working variables can drop across frequency channels is constant, that is, it produces a linear falling away of threshold as a function of channel distance. In the case of the analogue circuit, the rate at which the working variables drop away decreases as one proceeds farther and farther from a local maximum. The shape of the function is shown in FIG. 7 by the dashed line. A working surface computed in this way is a better match than a straight line to the filter response.

Although in the above example the first selector (7) received inputs via the second reducing means (**16*a*) and (16*b*) from only the adjacent channels it is possible for more than two channels within the frequency vacinity of a particular channel to supply working variables to the first selector (7**) of a particular channel. Thus, the working variables for all of the channels may be affected by the filterbank channel outputs of more than three channels.

One use for this method and apparatus will be in the analysis of speech waveforms. However, it will also be useful for analysing music, machine noise and other complex waveforms.

Figure 17:
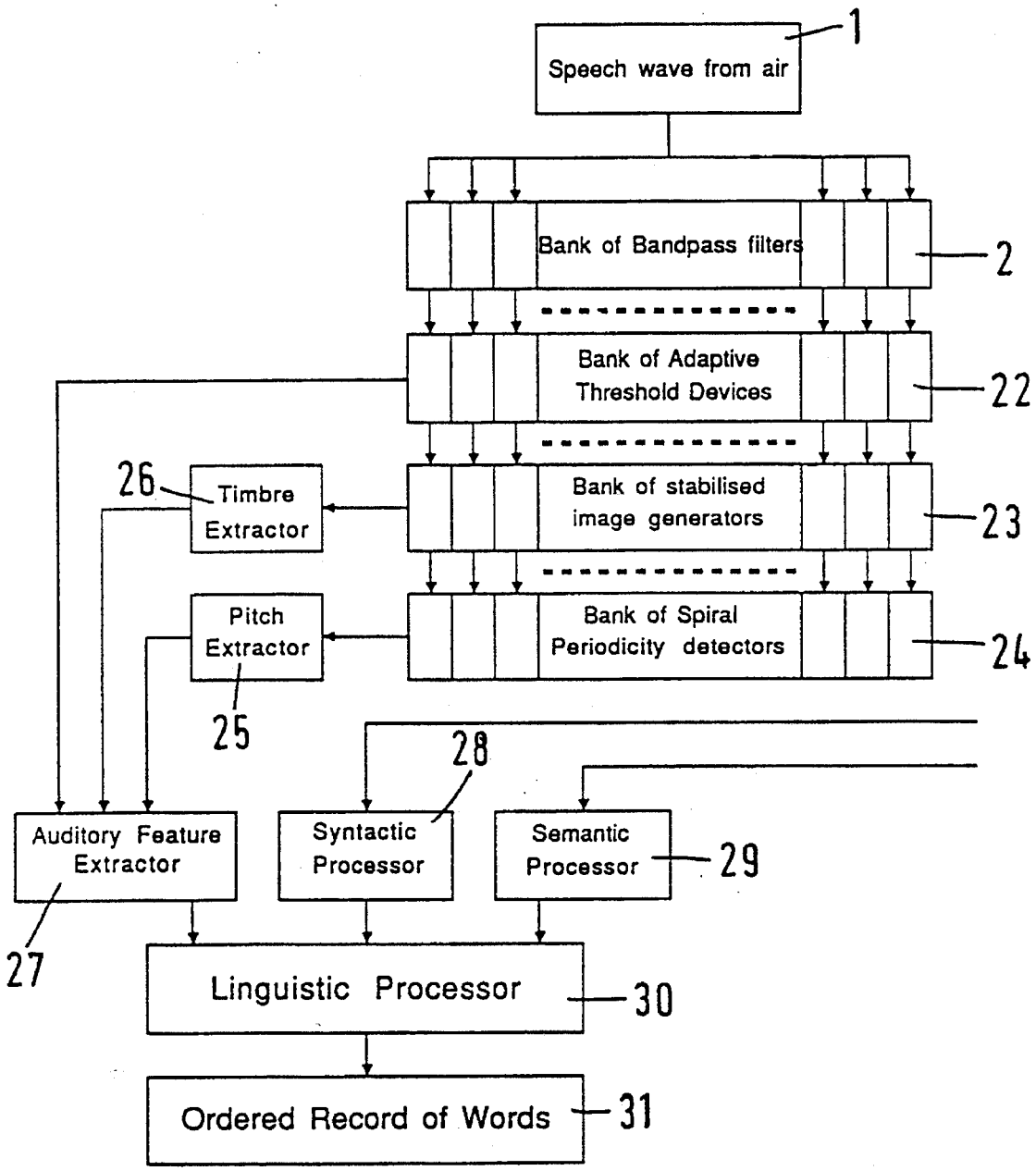
FIG. 17 is a schematic diagram of speech recognition apparatus according to the invention.

Refering now to FIG. 17 a schematic diagram of a speech recognition system is shown. A speech recognition machine is a system for capturing speech from the surrounding air and producing an ordered record of the words carried by the acoustic wave. The main components of such a device are: (a) a filterbank which divides the acoustic wave into frequency channels, (b) a set of devices that process the information in the channels to extract pitch and other speech features and (c) a linguistic process that analysis the features in conjunction with linguistic and possibly semantic knowledge to determine what was originally said.

The most important parts of speech for speech recognition purposes are the voiced parts of speech particularly vowel sounds. The voiced sounds are produced by the vibration of the air column in the throat and mouth by the opening and closing of the vocal chords. The resultant voiced sounds are periodic in nature, the pitch of the sound being the frequency of the glottal vibrations. Each vowel sound also has a distinctive arrangement of four formants which are dominant modulated harmonics of the pitch of the vowel sound and the relative frequencies of the four formants are not only characteristic of the vowel sound itself but are also characteristic of the speaker. For an effective speech recognition system it is necessary that as much information about the pitch and the formants of the voiced sounds is retained whilst also ensuring that other 'noise' does not interfere with the clear indentificiation of the pitch and formants.

The speech recognition system shown in FIG. 17 receives a speech wave (1) which is input into a bank of bandpass filters (2). The bank of bandpass filters (2) provides 24 frequency channels which vary from a low frequency of 100 Hz to a high frequency of 3700 Hz. Of course more channel filters over a much wider or narrower range of frequencies could also be used. The signals from all these channels are then input into a bank of adaptive threshold apparatus (22). These adaptive threshold apparatus (22) compress and rectify the input information and also act to sharpen characteristic features of the input information and reduce the effects of 'noise'. The output generated in each channel by the adaptive threshold apparatus (22) provides information on the major peak formations in the waveform transmitted by each of the channels in the filterbank (2). The information is then fed to a bank of stabilised image generators (23). The stabilised image generators adapt the incoming information by triggered intergration of the information in the form of pulse streams to produce stabilised representations or images of the input pulse streams. The stabilised images of the pulse streams are then input into a bank of spiral periodicity detectors (24) which detect periodicity in the input stabilised image and this information is fed into the pitch extractor (25). The pitch extractor (25) establishes the pitch of the speech wave (1) and inputs this information into an auditory feature extractor (27). The bank of stabilised image generators (23) also input into a timbre extractor (26). The timbre extractor (26) also inputs information regarding the timbre of the speech wave (1) into the auditory feature extractor (27). In addition there may be a direct input into the auditory feature extractor (27) from the bank of adaptive threshold devices (22). The auditory feature extractor (27), a syntactic processor (28) and a semantic processor (29) each provide inputs into a linguistic processor (30) which in turn provides an output (31) in the form of an ordered record of words.

The spiral peridicity detector (24) has been described in GB2169719 and will not be dealt with further here. The auditory feature extractor (27) may incorporate a memory device providing templates of various timbre arrays. It also receives an indication of any periodic features detected by the pitch extractor (25). It will be appreciated that the inputs to the auditory feature extractor (27) have a spectral dimension and so the feature extractor can make vowel distinctions on the basis of formant information like any other speech system. Similarly the feature extractor can distinuish between fricatives like /f/ and /s/ on a quasi-spectral basis. One of the advantages of the current arrangement is that temporal information is retained in the frequency channels when integration occurs.

The linguistic processor (30) derives an input from the auditory features extractor (27) as well as an input from the syntactic processor (28) which stores rules of language and imposes restrictions to help avoid ambiguity. The processor (30) also receives an input from the semantic processor (29) which imposes restrictions dependent on context so as to help determine particular interpretations depending on the context.

In the above example, the unit (23), (24), (25), and (26) may each comprise a programmed computing device arranged to process pulse signals in accordance with the program. The feature extractor (27) and processors (28), (29), (30), and (31) may each comprise a programmed computer or be provided in a programmed computer with memory means for storing any desired syntax or semantic rules and template for use in timbre extraction.

The mechanism has a further area of application: because the adaptive thresholding of a waveform is in a form that enables the resynthesis of an idealised signal which will have a larger signal to noise ratio than the original, the idealised signal should be more intelligible to people with impaired hearing. Thus, the adaptive threshold apparatus may be used as part of an aid to hearing.

The adaptive threshold apparatus may be used to improve the performance of multi-channel, compressive hearing aids. The output of each channel of the adaptive threshold apparatus indicates when that channel has potential signal information. This signal information can be used to gate the output of the filter in that channel and so produce a waveform-that has been edited to suppress noise in that channel. The set of edited waveforms from all the channels can then be recombined to produce a waveform which has an idealised version of the signal information. This idealised version of the signal should be more intelligible to people with impaired hearing.

Figure 18:
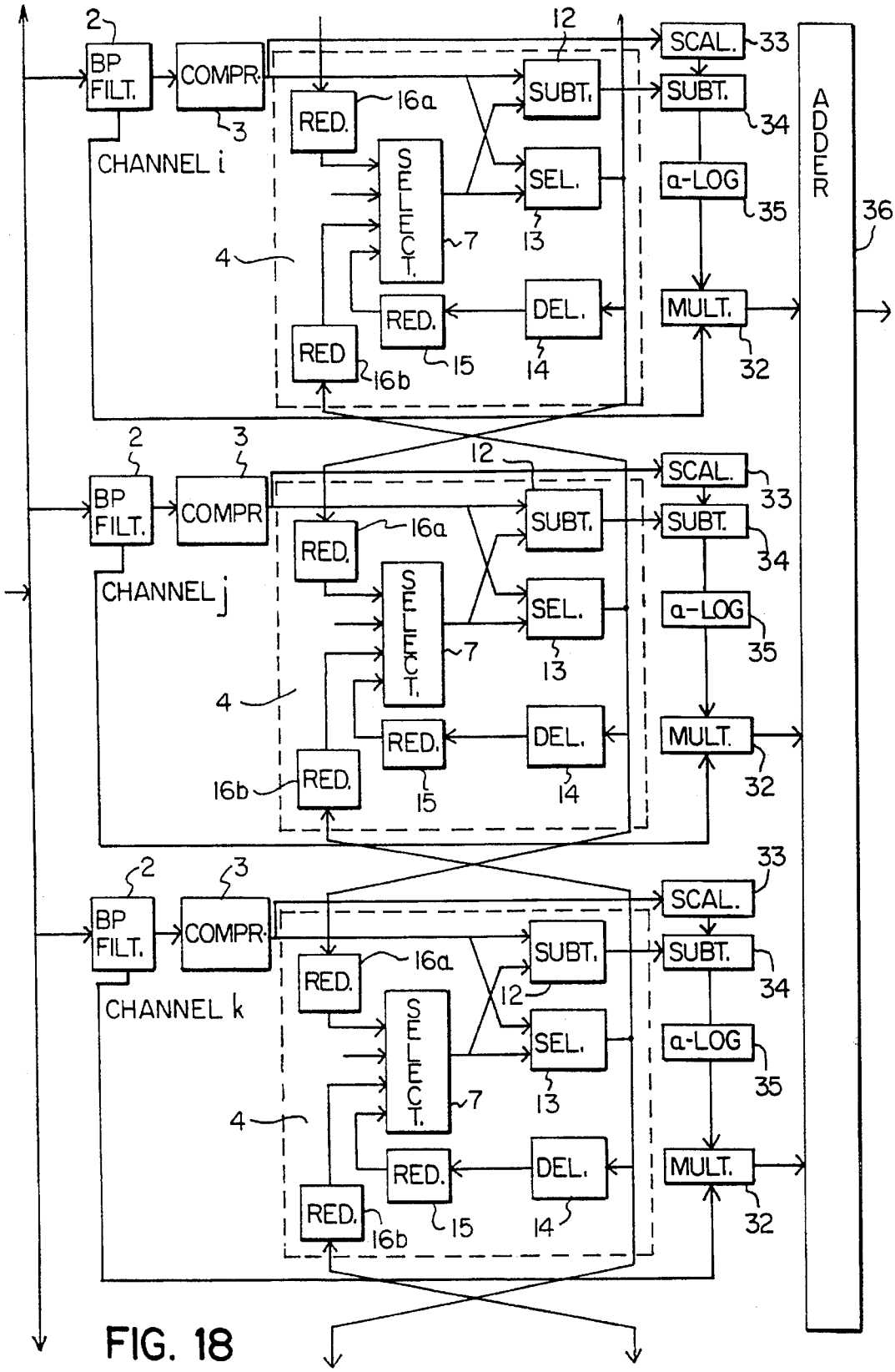
FIG. 18 is a schematic diagram of a hearing aid device including adaptive threshold apparatus according to the invention.

A hearing aid device incorporating the adaptive threshold apparatus is shown as a block diagram in FIG. 18 and has a similar structure to that shown in FIG. 9. In this case the output of the filterbank (2) which goes to the compressor (3) is the envelope of the filterbank signal rather than the waveform itself. The wave output from the bandpass filter however also goes directly to the multiplier (32) beyond the adaptive threshold apparatus (4). The output of the compressor (3) which is the input to the adaptive threshold apparatus (4) is also taken past the adaptive threshold apparatus (4) to a scaling device (33). The scaling coefficient of the scaling device (33) provides control of the amount of signal magnitude normalisation that occurs. The output of the scaling device (33) is subtracted by a subtracting device (34) from the thresholded output of the adaptive threshold apparatus (4). The result of this operation is then expanded through an anti-log device (35) and the result forms the second input to the multiplier (32). The output of the multiplier (32) is a gated version of the bandpass filter output in which the signal properties have been enhanced. The outputs of all of the channels can then be added together by an adding device (36) to form a waveform which has the signal properties from all of the channels combined and it is this waveform that forms the output of the hearing aid device.

We claim:

1. A method of analyzing a waveform comprising the steps of:

(a) separating the waveform spectrally into a plurality of frequency channel outputs;

(b) detecting amplitudes of each of said frequency channel outputs;

(c) producing a single respective threshold value for each detected amplitude in dependence on both (1) a previous frequency channel output amplitude detected in the same channel and (2) frequency channel output amplitudes detected in adjacent channels;

(d) comparing said detected amplitudes with a respective threshold value for each detected amplitude; and (e) generating, without short-time integration, a plurality of output signals representing said frequency channel output amplitudes relative to said respective threshold values, thereby simultaneously removing in both time and frequency domains aspects of the waveform caused by the analysis while retaining the definitional features of the waveform.

2. A method as claimed in claim 1, including repeating the separating, detecting, producing, comparing and generating steps for a successive waveform.

3. A method as claimed in claim 2, wherein the generating step comprises increasing the output signal for a selected frequency channel if the frequency channel output amplitude detected in an adjacent channel is greater than the frequency channel output amplitude detected in the selected channel.

4. A method as claimed in claim 2 including, after comparing, the step of increasing a selected respective threshold value if the amplitude of the corresponding frequency channel output is greater than the selected respective threshold value to which it is compared.

5. A method as claimed in claim 1, including the step of arranging the respective single threshold values to decay in a first direction across the channels across the frequency range and in a second direction along successive frequency channel output amplitudes.

6. A method as claimed in claim 5, including the step of preventing the respective single threshold values from decaying below a predetermined limit.

7. A method as claimed in claim 1, wherein generating the output signals comprises subtracting the respective single threshold values from the frequency channel output amplitudes.

8. A method as claimed in claim 1, wherein the step of generating a single respective threshold value for one frequency channel is responsive to the frequency channel amplitudes in immediately adjacent frequency channels either side of said one frequency channel.

9. A method as claimed in claim 8, wherein the step of generating a single respective threshold value for one frequency channel is responsive to the frequency channel amplitudes in more than one immediately adjacent frequency channel either side of said one frequency channel.

10. Apparatus for analyzing a waveform comprising:

(a) filtering means for separating the waveform spectrally into a plurality of frequency channel outputs;

(b) amplitude detector means for detecting amplitudes of said frequency channel outputs;

(c) threshold generating means, coupled to said amplitude detector means, for generating a respective single threshold value for each channel in dependance on both (1) a previous frequency channel output amplitude detected in the same channel and (2) frequency channel output amplitudes detected in adjacent frequency channels;

(d) comparator means coupled to said filtering means and said threshold generating means for comparing the amplitudes of each of said frequency channel outputs with said respective single threshold value for each frequency channel; and (e) output generating means coupled to said filtering means and said threshold generating means for generating, without short-time integration, a plurality of output signals representing frequency channel output amplitudes relative to said respective single threshold values by removing, in both time and frequency domains simultaneously, those features in the output of said filtering means which have been caused by said filtering means while retaining definitional features of the waveform in the plurality of output signals generated.

11. Apparatus as claimed in claim 10, wherein said comparator means is a subtracting device which subtracts the respective single threshold values in each channel from the frequency channel output amplitudes in the same channels, said output generating means generating an output signal whenever the result of the subtraction is a positive difference.

12. Apparatus as claimed in claim 10, wherein said threshold generating means includes a first selector which compares the respective single threshold value in each channel with the single threshold values in adjacent channels and which increases the respective single threshold value to form an adapted threshold value if an adjacent channel has a larger single threshold value.

13. Apparatus as claimed in claim 12, wherein said threshold generating means further includes a second selector which compares the respective single threshold values in each channel with the frequency channel output amplitudes in the same channels and which increases the respective single threshold value to form a revised threshold value if the frequency channel output amplitude is greater than the single threshold value with which the amplitude is compared.

14. Apparatus as claimed in claim 10, further comprising first and second reducing means coupled to said threshold generating means, said reducing means decaying the respective single threshold value for each channel in a first direction across the channels across the frequency range and in a second direction along successive frequency channel output amplitudes in the same channel, respectively.

15. Apparatus as claimed in claim 14, wherein the filtering means is a bandpass filterbank and the rate of decay in both said directions is less than the natural rate of decay of the output of each of the frequency channels of said filterbank.

16. Apparatus as claimed in claim 10, further comprising compressors coupled to the frequency channel outputs of the filtering means.

17. Apparatus as claimed in claim 10, wherein the waveform is a sound wave, and wherein there is further provided stabilized image generators for the triggered integration of the output signals to form stabilized images of the output signals.

18. Apparatus as claimed in claim 17, further comprising a periodicity detector coupled to the stabilized image generators for extracting periodic characteristics from the sound wave.

19. Apparatus as claimed in claim 17, further comprising at least one timbre extractor coupled to the stabilized image generators for extracting timbre characteristics from the sound wave.

20. Apparatus according to claim 10, further comprising means for extracting auditory features from the frequency channel outputs, and syntactic and semantic processor means for use in speech analysis of the waveform.

21. Apparatus according to claim 10, wherein the waveform is a sound wave, and further comprising combining means coupled to said threshold generating means for combining signals for each of the frequency channels with each other to form an output sound wave.

22. Apparatus according to claim 21, wherein the filtering means includes two outputs for each channel, a first output which is a waveform channel output and a second output which is an envelope function of the waveform channel output and wherein the combining means includes gating means, coupled to said threshold gating means and said filtering means, for applying the output signals for each of the frequency channels to respective waveform channel outputs to form gated output signals; and adding means coupled to said gating means, for adding said gated input signals for each of the frequency channels with each other to form the output sound wave.

23. Apparatus according to claim 22, further comprising controlling means, coupled to said threshold gating means, said filtering means and said gated means, for scaling said envelope functions for each of the frequency channels relative to said respective output signals such that the amount of variation in the magnitude of the output sound wave may be controlled.

* * * * *